US012582194B2

(12) United States Patent
Tateishi et al.

(10) Patent No.: US 12,582,194 B2
(45) Date of Patent: Mar. 24, 2026

(54) SOLE AND SHOE INCLUDING THE SAME

(71) Applicant: ASICS CORPORATION, Kobe (JP)

(72) Inventors: Yoshinori Tateishi, Kobe (JP); Toshiki Aiba, Kobe (JP)

(73) Assignee: ASICS CORPORATION, Kobe (JP)

( * ) Notice: Subject to any disclaimer, the term of this patent is extended or adjusted under 35 U.S.C. 154(b) by 2 days.

(21) Appl. No.: 18/620,338

(22) Filed: Mar. 28, 2024

(65) Prior Publication Data

US 2024/0324721 A1 Oct. 3, 2024

(51) Int. Cl.
*A43B 13/18* (2006.01)
*A43B 7/32* (2006.01)
*A43B 13/14* (2006.01)

(52) U.S. Cl.
CPC ..... *A43B 13/186* (2013.01); *A43B 7/32* (2013.01); *A43B 13/146* (2013.01); *A43B 13/187* (2013.01)

(58) Field of Classification Search
CPC ..... A43B 13/187
USPC ..... 36/28, 36 B, 29
See application file for complete search history.

(56) References Cited

U.S. PATENT DOCUMENTS 6,041,522 A * 3/2000 Anteby ..... A43B 13/20 36/103
7,020,988 B1 * 4/2006 Holden ..... A43B 7/1425 36/35 B
2002/0129516 A1 9/2002 Lucas et al.
2015/0013185 A1 1/2015 Elder et al.
2019/0231026 A1 8/2019 Fujita et al.
2022/0015499 A1 * 1/2022 Nakamura ..... A43B 13/16
2023/0000206 A1 1/2023 Hatano et al.

FOREIGN PATENT DOCUMENTS

JP H0838211 A * 2/1996
JP 2002238609 A * 8/2002
JP 2002320502 A 11/2002
WO 2018070045 A1 4/2018
WO 2021111667 A1 6/2021

OTHER PUBLICATIONS

Imai Takashi, Feb. 13, 1996, English Machine Translation_JP_H0838211A provided by Translate by EPO and Google (Year: 1996).*

(Continued)

*Primary Examiner* — Alissa L Hoey
*Assistant Examiner* — Akwokwo Olabisi Redhead
(74) *Attorney, Agent, or Firm* — Spencer Fane LLP

(57) ABSTRACT

A sole includes a midsole and an outsole. A portion of a rearfoot portion including a heel center includes a facing region in which the midsole and the outsole face each other at a distance from each other in an up-down direction, and the facing region includes a shock absorber. The midsole is a foam material. The shock absorber is a solid viscoelastic body and disposed to overlap or surround the heel center. A medial foot-side highly rigid member and a lateral foot-side highly rigid member are disposed at a medial foot-side end portion and a lateral foot-side end portion, respectively, in portions of the rearfoot portion that correspond to the facing region, so that the facing region includes a pocket-shaped space surrounding the shock absorber.

11 Claims, 13 Drawing Sheets

(56) References Cited

OTHER PUBLICATIONS

Kataoka Shiro, Aug. 27, 2002, English Machine Translation_JP_2002238609 provided by Translate by EPO and Google (Year: 2002).*
Japanese Office Action issued Dec. 5, 2023 in corresponding Japanese Application No. 2023-055534.
European Search Report issued May 7, 2024 in corresponding European Application No. 24165808.7.

* cited by examiner

SOLE AND SHOE INCLUDING THE SAME

REFERENCE TO RELATED APPLICATIONS

This nonprovisional application is based on Japanese Patent Application No. 2023-055534 filed on Mar. 30, 2023 with the Japan Patent Office, the entire contents of which are hereby incorporated by reference.

BACKGROUND

Technical Field

The present disclosure relates to a sole and a shoe including the sole.

Background Information

For example, International Publication Nos. WO2018/070045, WO 2021/111667, and the like each disclose a shoe having a sole including a shock absorber for the purpose of alleviating an impact applied when a foot lands on the ground.

The sole disclosed in International Publication No. WO2018/070045 includes a midsole, an outsole, and a shock absorber that is located to be sandwiched by the midsole and the outsole in a rearfoot portion that supports a heel portion of the wearer's foot.

Further, the sole disclosed in FIGS. 43 to 46 in International Publication No. WO2021/111667 includes a midsole, an outsole, and a shock absorber, and additionally, a relatively hard resin member as a less-deformable portion. In the sole disclosed in the above-mentioned publication, the resin member provided as a less-deformable portion is located to cover a bottom surface of the midsole in a rearfoot portion that supports a heel portion of the wearer's foot, and the shock absorber is located to be sandwiched by this less-deformable portion and the outsole.

SUMMARY

The soles disclosed in these publications exhibit excellent performance in terms of shock absorbing performance, stability, durability, and weight reduction. On the other hand, according to the recent demands for higher functionality for shoes, there has been a demand for implementing such shock absorbing performance, stability, durability, and weight reduction in higher dimensions. However, what is called a trade-off relation exists among shock absorbing performance, stability, durability and weight reduction, and it is significantly difficult to implement each of such performance in high dimensions without impairing any of such performance.

For example, in the sole disclosed in International Publication No. WO2018/070045, the shock absorber is disposed along the peripheral edge of the rearfoot portion, but no shock absorber is located at the heel center of the rearfoot portion and around the heel center, and thus, there is still room for improvement in terms of the shock absorbing performance. In this regard, simply disposing the shock absorber to reach the heel center can inhibit the weight reduction and the stability.

Further, in the sole disclosed in International Publication No. WO2021/111667, a less-deformable portion is disposed on the bottom surface of the midsole, and there is still room for improvement in terms of the shock absorbing performance and weight reduction. In this regard, simply removing the less-deformable portion can significantly inhibit the stability.

Thus, the present disclosure has been made in view of the above-described problems, and an object of the present disclosure is to provide: a shoe excellent in shock absorbing performance, stability, durability, and weight reduction; and a sole provided in the shoe.

A sole according to the present disclosure includes: a midfoot portion configured to support an arch portion of the foot of the wearer; a forefoot portion located in front of the midfoot portion; and a rearfoot portion located behind the midfoot portion. The sole includes: a midsole; and an outsole located beneath the midsole. The midsole is made of a foam material. The rearfoot portion includes a facing region in which the midsole and the outsole are disposed to face each other at a distance from each other in an up-down direction, the facing region being located in a portion including a heel center of the sole when viewed in a direction normal to a bottom surface of the sole. The facing region includes a shock absorber formed of a solid viscoelastic body, the shock absorber being sandwiched in the up-down direction by the midsole and the outsole. The shock absorber is located to overlap or surround the heel center. At a medial foot-side end portion in a portion of the rearfoot portion that corresponds to the facing region, a medial foot-side highly rigid member having a panel shape is provided, the medial foot-side highly rigid member being higher in rigidity than the shock absorber. At a lateral foot-side end portion in a portion of the rearfoot portion that corresponds to the facing region, a lateral foot-side highly rigid member having a panel shape is provided, the lateral foot-side highly rigid member being higher in rigidity than the shock absorber. In the sole according to the present disclosure, a pocket-shaped space that surrounds the shock absorber is provided in the facing region by fixing a top side portion of the medial foot-side highly rigid member to the midsole and fixing a bottom side portion of the medial foot-side highly rigid member to the outsole such that the medial foot-side highly rigid member is disposed to face the shock absorber at a distance from the shock absorber in a left-right direction, and by fixing a top side portion of the lateral foot-side highly rigid member to the midsole and fixing a bottom side portion of the lateral foot-side highly rigid member to the outsole such that the lateral foot-side highly rigid member is disposed to face the shock absorber at a distance from the shock absorber in the left-right direction.

A shoe according to the present disclosure includes: the sole according to the present disclosure; and an upper provided above the sole.

The foregoing and other objects, features, aspects, and advantages of the present disclosure will become apparent from the following detailed description of the present disclosure, which is understood in conjunction with the accompanying drawings.

DETAILED DESCRIPTION

Figure 1:
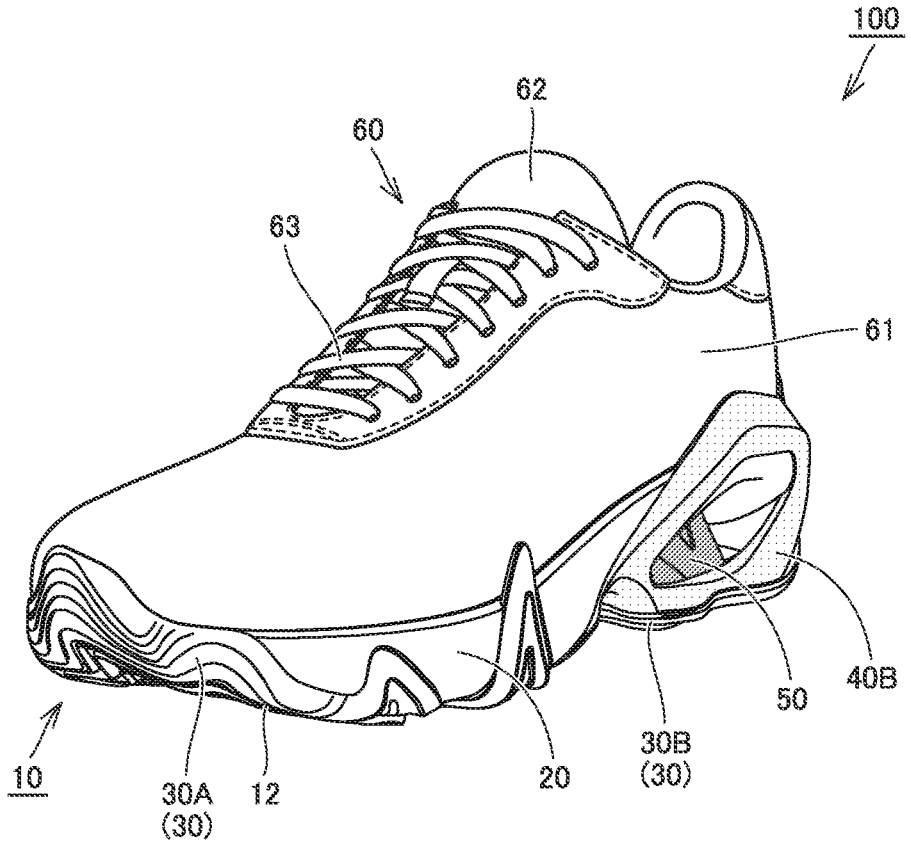
FIG. 1 is a schematic perspective view of a shoe according to an embodiment.

The following describes an embodiment in detail with reference to the accompanying drawings. In the embodiment described below, the same or corresponding portions are denoted by the same reference characters, and the description thereof will not be repeated.

Embodiment

Figure 2:
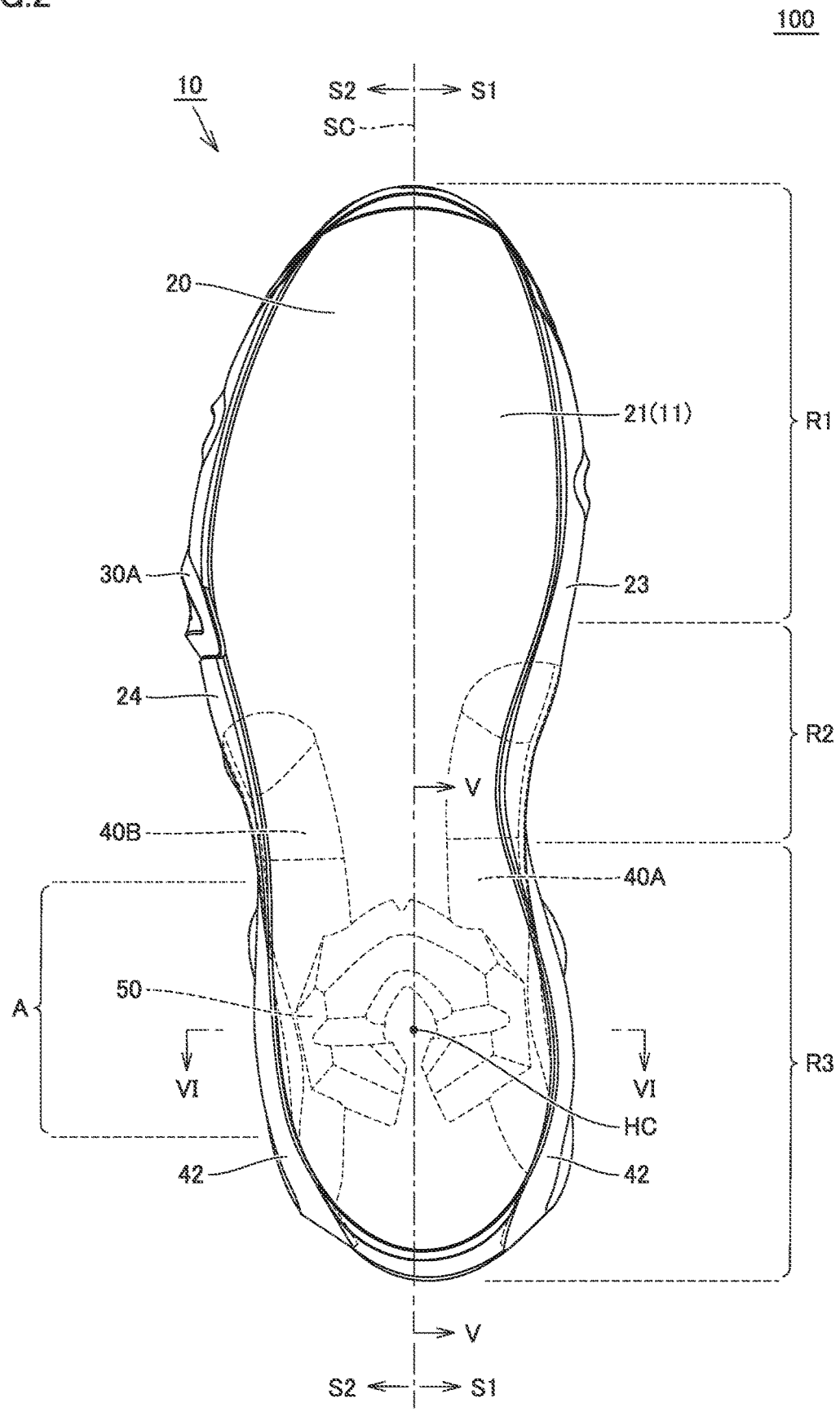
FIG. 2 is a schematic plan view of a sole shown in FIG. 1.
Figure 3:
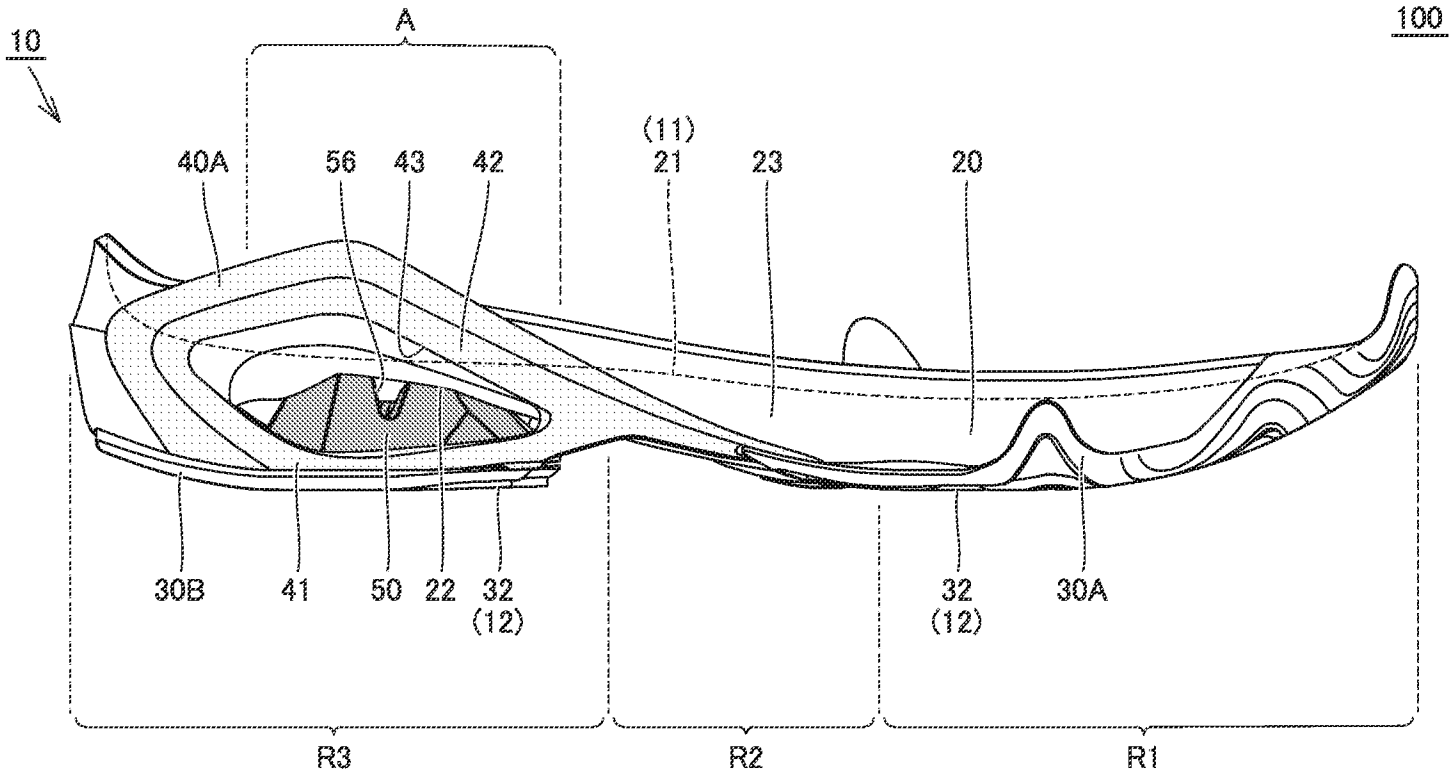
FIG. 3 is a schematic side view of the sole shown in FIG. 1 when viewed from a medial foot side.
Figure 4:
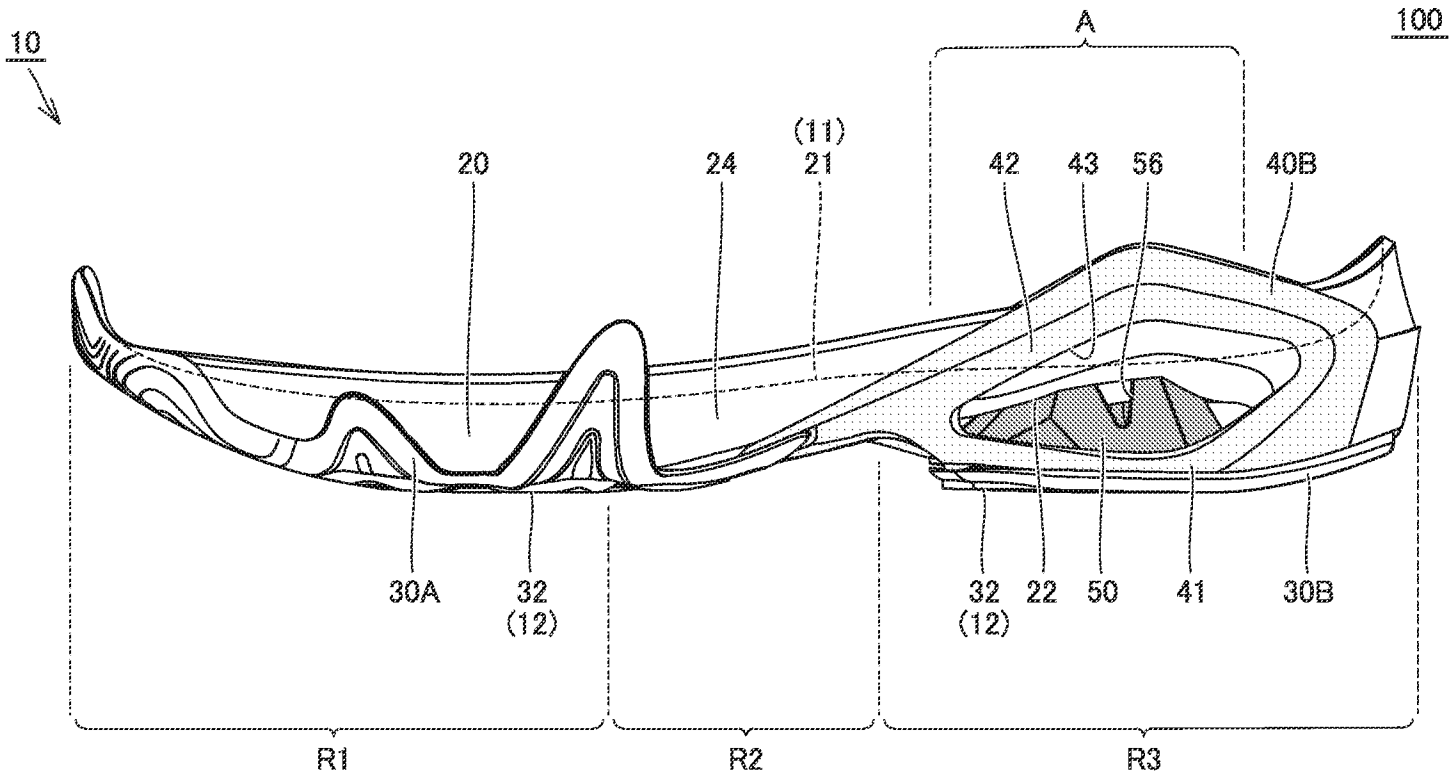
FIG. 4 is a schematic side view of the sole shown in FIG. 1 when viewed from a lateral foot side.
Figure 5:
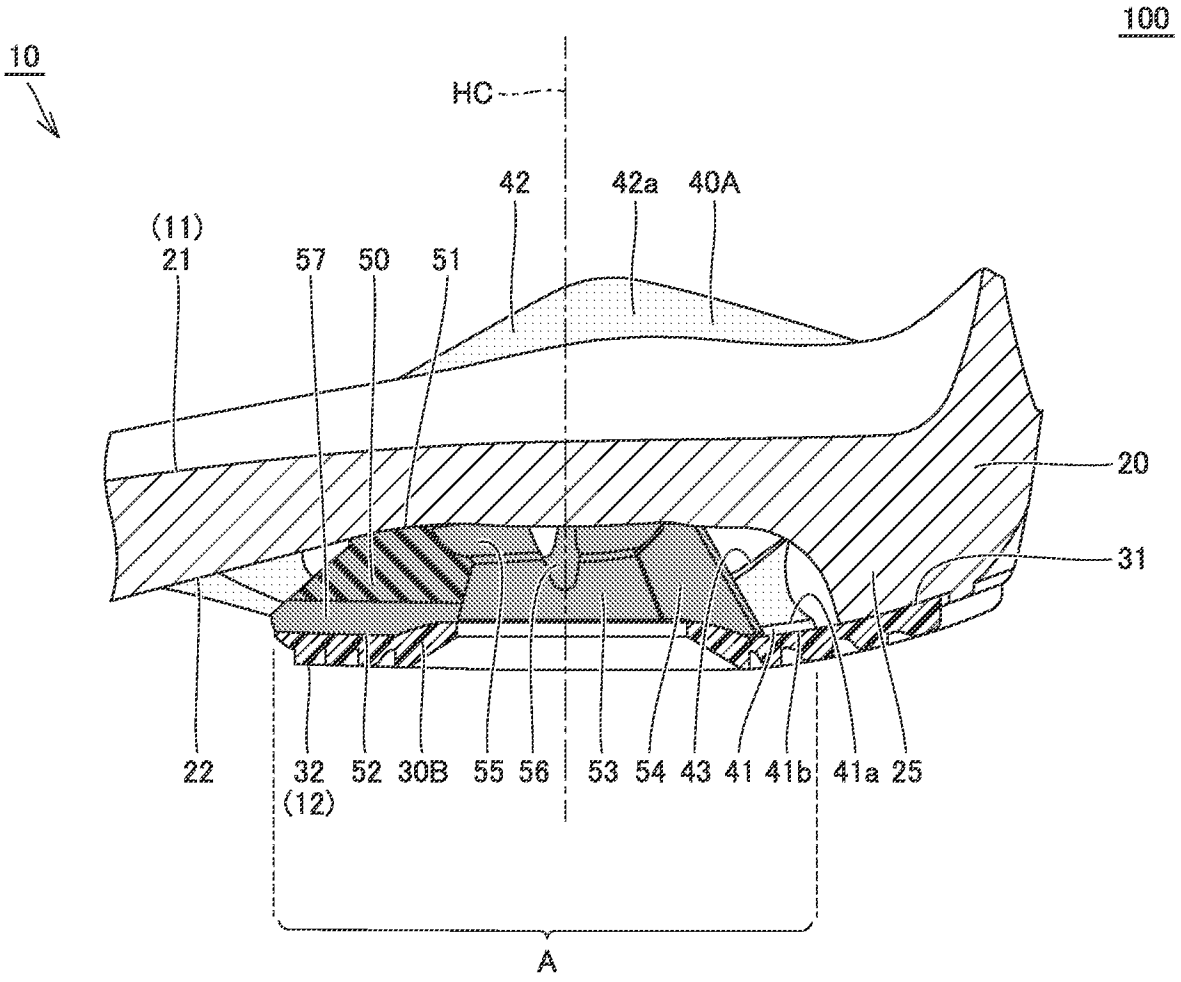
FIG. 5 is a schematic cross-sectional view taken along a line V-V shown in FIG. 2.
Figure 6:
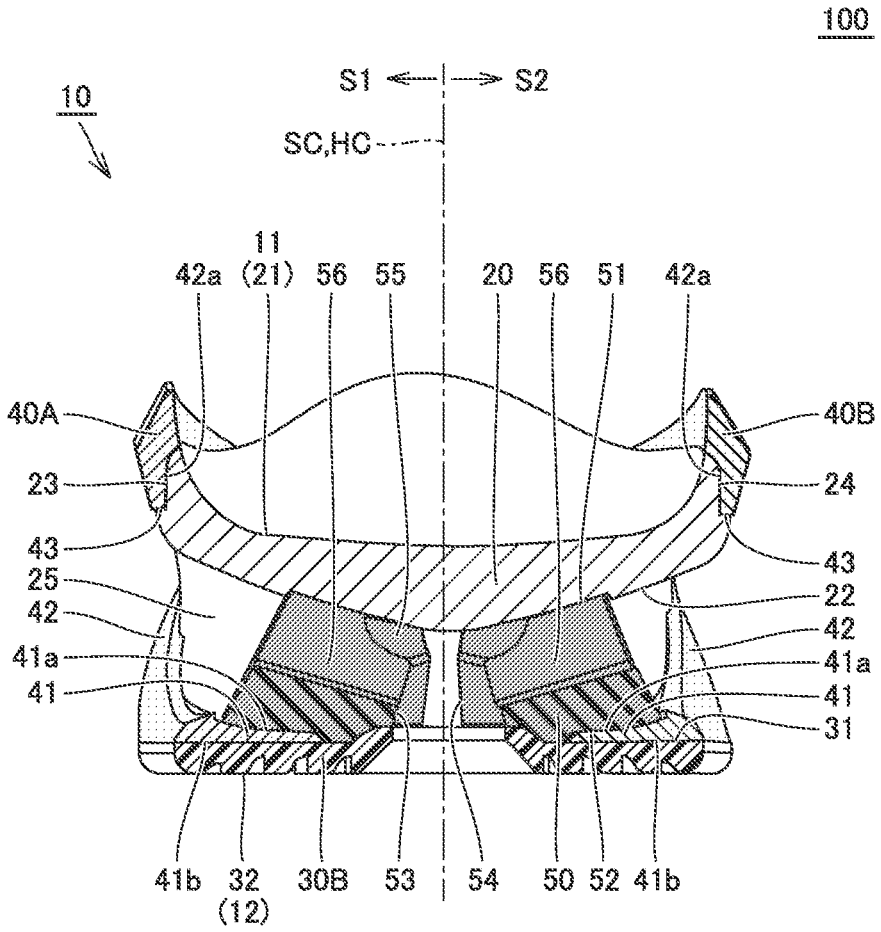
FIG. 6 is a schematic cross-sectional view taken along a line VI-VI shown in FIG. 2.
Figure 7:
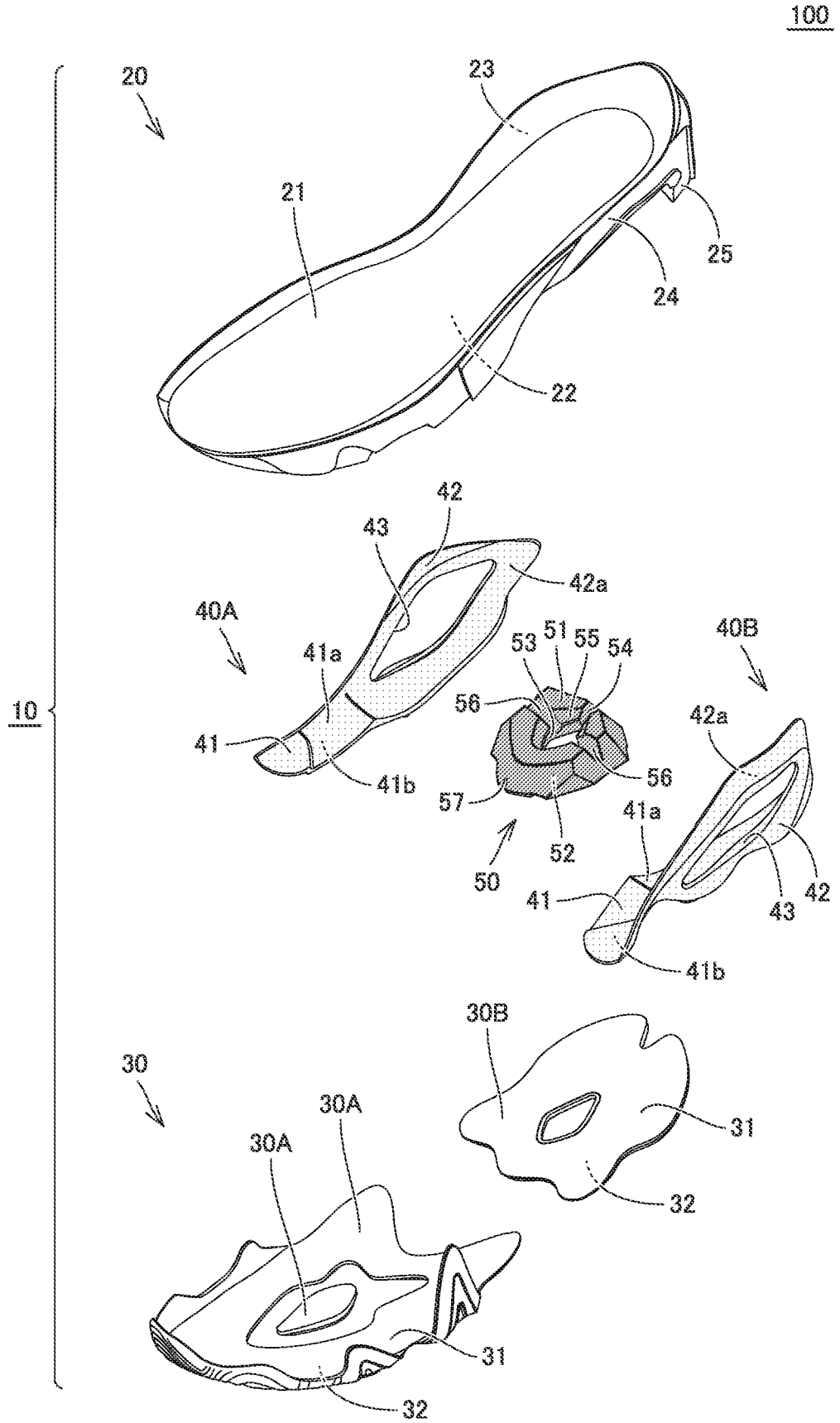
FIG. 7 is an exploded perspective view of the sole shown in FIG. 1.
Figure 8:
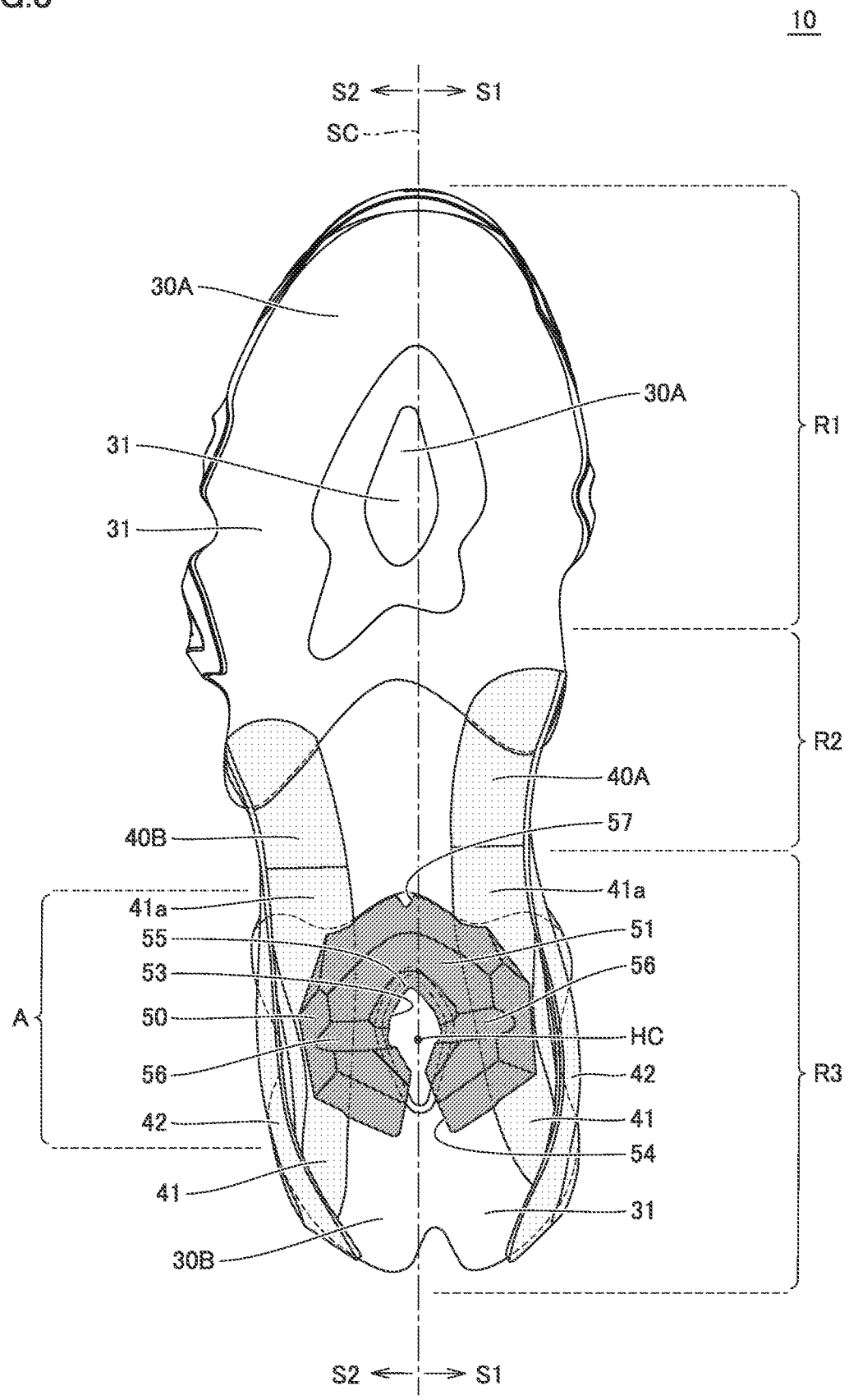
FIG. 8 is a schematic plan view showing a state in which a midsole has been removed from the sole shown in FIG. 1.
Figure 9:
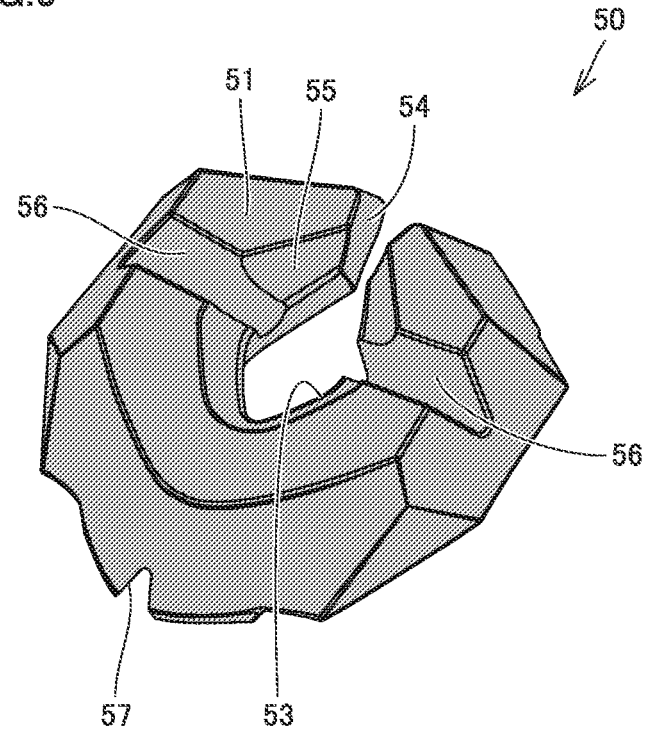
FIG. 9 is a perspective view of a shock absorber shown in FIG. 1 when viewed from a top surface side.
Figure 10:
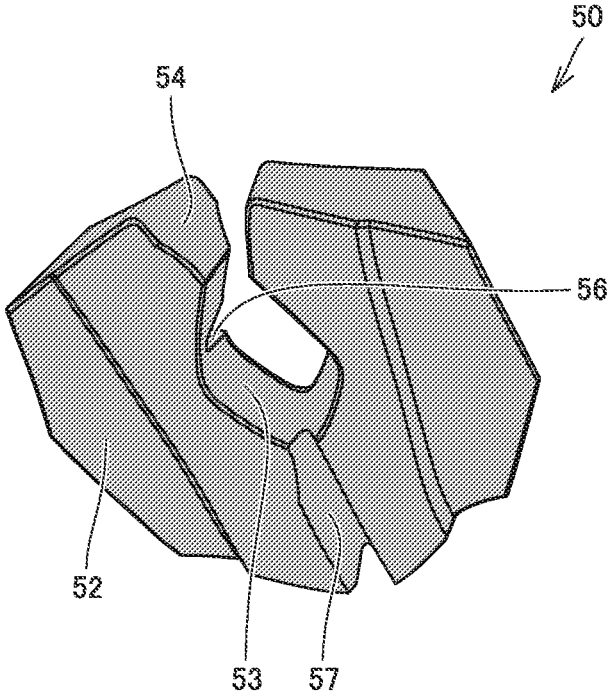
FIG. 10 is a perspective view of the shock absorber shown in FIG. 1 when viewed from a bottom surface side.

FIG. 1 is a schematic perspective view of a shoe according to an embodiment, and FIG. 2 is a schematic plan view of a sole shown in FIG. 1. FIGS. 3 and 4 are schematic side views of the sole shown in FIG. 1 when viewed from the medial foot side and the lateral foot side, respectively. FIGS. 5 and 6 are schematic cross-sectional views taken along a line V-V and a line VI-VI, respectively, shown in FIG. 2. FIG. 7 is an exploded perspective view of the sole shown in FIG. 1. FIG. 8 is a schematic plan view showing the state in which a midsole has been removed from the sole shown in FIG. 1. FIGS. 9 and 10 are perspective views of a shock absorber shown in FIG. 1 when viewed from the top surface side and the bottom surface side, respectively. Referring to these FIGS. 1 to 10, the following describes a shoe 100 according to the present embodiment and a sole 10 provided in the shoe 100.

As shown in FIG. 1, the shoe 100 includes a sole 10 and an upper 60. The sole 10 has a substantially flat shape, and includes: a top surface defining a supporting surface 11 (see FIGS. 2 to 4 and the like) that supports a bottom of the wearer's foot; a bottom surface defining a ground contact surface 12 that lands on the ground during use such as during walking and running; and a medial foot-side side surface and a lateral foot-side side surface that connect the top surface and the bottom surface. The sole 10 is a member that supports the bottom of the wearer's foot. The upper 60 is located above the sole 10 and shaped to cover the substantially entire portion extending from an ankle of the inserted wearer's foot to a distal end.

As shown in FIGS. 2 to 4, the sole 10 is divided into a forefoot portion R1, a midfoot portion R2, and a rearfoot portion R3 in a front-rear direction (in an up-down direction in FIG. 2 and a left-right direction in FIGS. 3 and 4) that corresponds to a foot length direction of the wearer's foot in a plan view. The forefoot portion R1 supports a toe portion and a ball portion of the wearer's foot, the midfoot portion R2 supports an arch portion of the wearer's foot, and the rearfoot portion R3 supports a heel portion of the wearer's foot.

In this case, with reference to the front end of the sole 10, a first boundary position is defined at a position located at 40% of the dimension of the sole 10 from the front end in the front-rear direction, and a second boundary position is defined at a position located at 60% of the dimension of the sole 10 from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe sole in the front-rear direction.

Further, as shown in FIG. 2, the sole 10 is divided into a medial foot-side portion (a portion on the S1 side shown in the figure) and a lateral foot-side portion (a portion on the S2 side shown in the figure) in the left-right direction corresponding to a foot width direction of the wearer's foot (in the left-right direction in the figure) when seen in a plan view. In this case, the medial foot-side portion corresponds to the medial side of the foot in anatomical position (i.e., the side close to the midline) and the lateral foot-side portion is opposite to the medial side of the foot in anatomical position (i.e., the side away from the midline).

In this case, a boundary line that divides the sole 10 into the medial foot-side portion and the lateral foot-side portion is what is called a shoe center SC. The shoe center SC is an imaginary straight line obtained by projecting a straight line onto the sole 10 in the up-down direction in the state in which a standard wearer having a foot size suitable for the shoe 100 wears the shoe 100, the straight line connecting a central portion of a calcaneus bone (what is called a heel center (the heel center is denoted by reference characters "HC" in FIG. 2 and the like)) to a portion between the first toe and the second toe of this standard wearer. The front end and the rear end of the sole 10 described above correspond to the ends of the sole 10 located on the shoe center SC.

As shown in FIG. 1, the upper 60 includes an upper body 61, a shoe tongue 62, and a shoelace 63. Among them, the shoe tongue 62 and the shoelace 63 each are fixed or attached to the upper body 61.

The upper body 61 has a top portion including a top side opening through which the upper portion of an ankle of the wearer's foot and a part of the instep of the wearer's foot are exposed. Further, the upper body 61 has a bottom portion including, as one example, a bottom side opening covered by the sole 10 and, as another example, a bottom portion formed by stitching the bottom end of the upper body 61 with French seam or the like.

The shoe tongue 62 is fixed to the upper body 61 by sewing, welding, bonding, or a combination thereof so as to cover a portion of the top side opening disposed in the upper body 61 through which a part of the instep of the wearer's foot is exposed. For the upper body 61 and the shoe tongue 62, for example, woven fabric, knitted fabric, nonwoven fabric, synthetic leather, resin, or the like can be used. For shoes particularly required to be air permeable and lightweight, a double raschel warp knitted fabric with a polyester yarn knitted therein can be used.

The shoelace 63 is formed of a member in the form of a string for pulling together, in the foot width direction of the wearer's foot, portions of a peripheral edge of the top side opening which is disposed in the upper body 61 and through which a part of the instep of the wearer's foot is exposed. The shoelace 63 is passed through a plurality of holes disposed along the peripheral edge of the top side opening. When the shoelace 63 is tightened in the state in which the wearer's foot is inserted into the upper body 61, the upper body 61 can be brought into close contact with the foot.

As shown in FIGS. 1 to 7, the sole 10 includes a midsole 20, an outsole 30, a medial foot-side highly rigid member 40A, a lateral foot-side highly rigid member 40B, and a shock absorber 50. In this case, in FIGS. 1 to 8 excluding FIG. 2, in order to facilitate understanding, the medial foot-side highly rigid member 40A and the lateral foot-side highly rigid member 40B are shown in light color, and the shock absorber 50 is shown in dark color (the same applies to FIGS. 8 to 10 and FIGS. 11A to 14 described later).

The midsole 20 is disposed in a top side area of the sole 10 while the outsole 30 is disposed in a bottom side area of the sole 10. The medial foot-side highly rigid member 40A and the lateral foot-side highly rigid member 40B are disposed at the medial foot-side end portion and the lateral foot-side end portion, respectively, close to the rear end of the sole 10, and the shock absorber 50 is disposed at a prescribed position close to the rear end of the sole 10.

As shown in FIGS. 1 to 7, the midsole 20 is a portion serving as a base of the sole 10 and is located to continuously extend from the forefoot portion R1 through the midfoot portion R2 to the rearfoot portion R3. The midsole 20 has a substantially flat plate shape and is relatively thicker than the outsole 30 which will described later.

Referring particularly to FIG. 7, the midsole 20 includes a top surface 21, a bottom surface 22, a medial foot-side side surface 23, and a lateral foot-side side surface 24, among which the top surface 21 defines the above-mentioned supporting surface 11 of the sole 10. The top surface 21 of the midsole 20 is bonded to the upper body 61, for example, by adhesion or the like, and thereby, the sole 10 is fixed to the upper 60 (see FIG. 1).

The top surface 21 of the midsole 20 has a peripheral edge shaped to protrude more than a region of the top surface 21 that excludes this peripheral edge. Thereby, the top surface 21 of the midsole 20 includes a recessed portion in which the upper 60 is received. The top surface 21 of the midsole 20 in the portion of the bottom surface of this recessed portion that excludes the above-mentioned peripheral edge has a smooth curved surface so as to be fitted to the bottom of the wearer's foot.

In this case, particularly as shown in FIGS. 3 to 5, the bottom surface 22 of the midsole 20 has an inclined shape extending from a portion close to the rear end of the midfoot portion R2 to the rearfoot portion R3 so as to be inclined upward toward the rear end of the sole 10. Further, particularly as shown in FIGS. 5 and 7, a leg portion 25 protruding downward is provided at the rear end portion of the bottom surface 22 of the midsole 20. The portion of the bottom surface 22 that has the above-mentioned inclined shape and the leg portion 25 provide a recessed cutout portion at a prescribed position in the bottom surface 22 of the midsole 20. This recessed cutout portion provides a facing region A (see FIGS. 2 to 5 and the like), which will be described later in detail.

The midsole 20 can be formed of a single member or can be divided into a plurality of members. For example, when the midsole 20 is divided into a plurality of members, a highly rigid plate is interposed between these divided members and thereby can be embedded in the midsole 20. The highly rigid plate, which is a member different from the medial foot-side highly rigid member 40A and the lateral foot-side highly rigid member 40B (described later), serves to suppress dorsiflexion occurring in the sole particularly during running to thereby increase the forward propulsive force at the time when the foot pushes off the ground.

The midsole 20 is preferably excellent in shock absorbing performance while having proper strength. From this viewpoint, the midsole 20 is made, for example, using a resin-made foam material containing: a resin material as a main component; and a foaming agent and a cross-linking agent as sub-components. Alternatively, the midsole 20 can be made using a rubber-made foam material containing: a rubber material as a main component; and a plasticizer, a foaming agent, a reinforcing agent, and a cross-linking agent as sub-components.

Examples of the above-mentioned resin material applicable in this case can be an ethylene-vinyl acetate copolymer (EVA), a polyolefin resin, thermoplastic polyurethane, a thermoplastic polyamide-based elastomer (TPA, TPAE), a thermoplastic polyester-based elastomer, or the like. Examples of the above-mentioned rubber material suitably applicable in this case can be butadiene rubber.

Thereby, the midsole 20 is formed of a soft member with a lower Young's modulus. Thus, the midsole 20 is relatively easily elastically deformed when it receives a compressive load, and thereby, attains excellent shock absorbing performance.

As shown in FIGS. 1 to 7, the outsole 30 is assembled mainly to the midsole 20 and has a substantially flat plate shape. The outsole 30 is relatively thinner than the midsole 20.

Referring particularly to FIG. 7, the outsole 30 includes a top surface 31 and a bottom surface 32, of which the bottom surface 32 defines the above-mentioned ground contact surface 12 of the sole 10. In order to improve grip performance, the bottom surface 32 of the outsole 30 can include protrusions and recesses to form a tread pattern. The top surface 31 of the outsole 30 is bonded mainly to the bottom surface 22 of the midsole 20 by adhesion or the like, and in addition, bonded for example by adhesion or the like to the medial foot-side side surface 23 and the lateral foot-side side surface 24 of the midsole 20, the medial foot-side highly rigid member 40A, the lateral foot-side highly rigid member 40B, and the shock absorber 50.

The outsole 30 can be formed of a single member or can be divided into a plurality of members. Further, the outsole 30 can be located to extend continuously, for example, from the forefoot portion R1 through the midfoot portion R2 to the rearfoot portion R3 or can be provided only in the forefoot portion R1 and the rearfoot portion R3 except for the midfoot portion R2.

In the present embodiment, the outsole 30 is mainly divided into a front-side outsole 30A and a rear-side outsole 30B. More specifically, the front-side outsole 30A is located to extend in the forefoot portion R1 and a portion of the midfoot portion R2 close to its front end, and the rear-side outsole 30B is located to extend in a portion of the midfoot portion R2 close to its rear end and the rearfoot portion R3. In the present embodiment, the front-side outsole 30A is formed of two members including: a small-sized member located in the central area of the forefoot portion R1; and a large-sized member having an annular shape and located to surround the small-sized member.

The outsole 30 is preferably excellent in wear resistance and grip performance. From this viewpoint, the outsole 30 is formed using a member, for example, made of a material containing: a rubber material as a main component; and a plasticizer, a reinforcing agent, and a cross-linking agent as subcomponents. As the rubber material, for example, butadiene rubber can be suitably used.

Thereby, the outsole 30 is substantially formed of a hard member with a higher Young's modulus. Thus, the outsole 30 is excellent in durability such as wear resistance.

As shown in FIGS. 1 to 7, both the medial foot-side highly rigid member 40A and the lateral foot-side highly rigid member 40B are assembled mainly to the midsole 20, and each are formed of a panel-shaped member. The medial foot-side highly rigid member 40A and the lateral foot-side highly rigid member 40B are provided in the sole 10 mainly in order to locally increase the rigidity of the sole 10 and thereby increase the stability at the time of landing on the ground.

Referring particularly to FIG. 7, each of the medial foot-side highly rigid member 40A and the lateral foot-side highly rigid member 40B includes a bottom wall portion 41 having a substantially flat plate shape and a sidewall portion 42 having a curved partition-like shape, and thus, has a substantially L-shaped cross section. In this way, the medial foot-side highly rigid member 40A and the lateral foot-side highly rigid member 40B are identical in basic structure but are different in detailed shape, size, and the like as shown in the figure.

More specifically, as shown in FIGS. 2 to 8, the medial foot-side highly rigid member 40A includes: a bottom wall portion 41 (corresponding to a first bottom wall portion) extending substantially in the front-rear direction and the left-right direction and extending along the medial foot-side end portion of the sole 10; and a sidewall portion 42 (corresponding to a first sidewall portion) provided to stand upright from a medial foot-side edge portion of the bottom wall portion 41, extending substantially in the front-rear direction and the up-down direction, and extending along the medial foot-side end portion of the sole 10. The medial foot-side highly rigid member 40A is located to extend from a portion of the midfoot portion R2 close to its front end to the rear end of the rearfoot portion R3.

On the other hand, the lateral foot-side highly rigid member 40B includes: a bottom wall portion 41 (corresponding to a second bottom wall portion) extending substantially in the front-rear direction and the left-right direction and extending along the lateral foot-side end portion of the sole 10; and a sidewall portion 42 (corresponding to a second sidewall portion) provided to stand upright from the lateral foot-side edge portion of the bottom wall portion 41, extending substantially in the front-rear direction and the up-down direction, and extending along the lateral foot-side end portion of the sole 10. The lateral foot-side highly rigid member 40B extends from a substantially central portion of the midfoot portion R2 in the front-rear direction to the rear end of the rearfoot portion R3.

In this case, as described above, the bottom surface 22 of the midsole 20 includes a recessed cutout portion that is formed by the portion of the bottom surface 22 that has the inclined shape and the leg portion 25. Referring particularly to FIGS. 3 to 6, in a portion including the above-mentioned recessed cutout portion, i.e., a portion of the rearfoot portion R3 excluding its rear end and a portion of the midfoot portion R2 close to its rear end, the facing region A is formed in which the midsole 20 and the outsole 30 face each other at a distance from each other in the up-down direction. The facing region A is located to include the heel center HC of the sole 10 when viewed in the direction normal to the ground contact surface 12.

The medial foot-side highly rigid member 40A and the lateral foot-side highly rigid member 40B are provided at the positions corresponding to the facing region A, and more specifically provided at the portions in the medial foot-side end portion and the lateral foot-side end portion of the sole 10 where the facing region A is provided. In other words, the medial foot-side highly rigid member 40A and the lateral foot-side highly rigid member 40B are disposed at a pair of end portions of the facing region A in the left-right direction. Thereby, the medial foot-side highly rigid member 40A and the lateral foot-side highly rigid member 40B are interposed between the midsole 20 and the outsole 30 at the pair of end portions of the facing region A in the left and right direction.

More specifically, the medial foot-side highly rigid member 40A has a bottom surface 41*b* of the bottom wall portion 41 that corresponds to its bottom side portion, and the bottom surface 41*b* is bonded to the top surface 31 of the rear-side outsole 30B, for example, by adhesion or the like. Further, the medial foot-side highly rigid member 40A has a lateral foot-side wall surface 42*a* of the sidewall portion 42 that corresponds to its top side portion, and the lateral foot-side wall surface 42*a* is bonded to the medial foot-side side surface 23 of the midsole 20, for example, by adhesion or the like. Thereby, the medial foot-side highly rigid member 40A is interposed between the midsole 20 and the rear-side outsole 30B mainly at the medial foot-side end portion of the rearfoot portion R3.

On the other hand, the lateral foot-side highly rigid member 40B has a bottom surface 41*b* of the bottom wall portion 41 that corresponds to its bottom side portion, and the bottom surface 41*b* is bonded to the top surface 31 of the rear-side outsole 30B, for example, by adhesion or the like. Further, the lateral foot-side highly rigid member 40B has a medial foot-side wall surface 42*a* of the sidewall portion 42 that corresponds to its top side portion, and the medial foot-side wall surface 42*a* is bonded to the lateral foot-side side surface 24 of the midsole 20, for example, by adhesion or the like. Thereby, the lateral foot-side highly rigid member 40B is interposed mainly between the midsole 20 and the rear-side outsole 30B at the lateral foot-side end portion of the rearfoot portion R3.

Accordingly, the rear-side outsole 30B is provided to extend over the bottom surface 41*b* of the bottom wall portion 41 of each of the medial foot-side highly rigid member 40A and the lateral foot-side highly rigid member 40B, and the bottom surface of the leg portion 25 of the midsole 20 so as to cover each of these bottom surfaces, and is also bonded to each of these bottom surfaces, so that the rear-side outsole 30B is attached indirectly to the midsole 20 with the medial foot-side highly rigid member 40A and the lateral foot-side highly rigid member 40B interposed therebetween, and also attached directly to the leg portion 25 of the midsole 20.

In such a configuration, as shown in FIGS. 3 to 6, a pocket-shaped space defined by the midsole 20, the rear-side outsole 30B, the medial foot-side highly rigid member 40A, and the lateral foot-side highly rigid member 40B is formed at a prescribed position inside the sole 10. More specifically, this pocket-shaped space is located in the sole 10 to extend over a portion of the rearfoot portion R3 excluding its rear end and a portion of the midfoot portion R2 close to its rear end.

The medial foot-side highly rigid member 40A and the lateral foot-side highly rigid member 40B each are formed of a member higher in rigidity than the midsole 20 and the shock absorber 50 which will be described later in detail, and more preferably formed of a member higher in rigidity than the outsole 30. In other words, the medial foot-side highly rigid member 40A and the lateral foot-side highly rigid member 40B each are higher in Young's modulus and higher in hardness than the midsole 20 and the shock absorber 50.

The materials of the medial foot-side highly rigid member 40A and the lateral foot-side highly rigid member 40B are not particularly limited, but examples of the materials suitably applicable in this case can be: non-fiber-reinforced resin made of a polymer resin such as a urethane-based thermoplastic elastomer (TPU), an amide-based thermoplastic elastomer (TPA), or an ethylene-vinyl acetate copolymer (EVA); or fiber-reinforced resin formed using, as reinforcing fibers, carbon fibers, glass fibers, aramid fibers, Dyneema fibers, Zylon fibers, boron fibers, or the like.

The sidewall portion 42 of each of the medial foot-side highly rigid member 40A and the lateral foot-side highly rigid member 40B has a substantially rhombus shape in a side view. When each sidewall portion 42 has such a shape, in a side view, the portions of the medial foot-side highly rigid member 40A and the lateral foot-side highly rigid member 40B that overlap the heel center HC can be larger in dimension in the up-down direction than the portions of the medial foot-side highly rigid member 40A and the lateral foot-side highly rigid member 40B that do not overlap the heel center HC.

Therefore, according to such a configuration, the portion of the sole 10 in the vicinity of the heel center HC at which a higher load is applied when landing on the ground can be higher in rigidity than the portion of the sole 10 that is away from the heel center HC. This makes it possible to implement a well-balanced configuration excellent in shock absorbing performance and stability achieved as a whole when a foot lands on the ground.

Further, the sidewall portion 42 of each of the medial foot-side highly rigid member 40A and the lateral foot-side highly rigid member 40B includes a through hole 43 penetrating through the sidewall portion 42 in the left-right direction. By providing the through hole 43, the sidewall portion 42 is more easily deformable than the case where no through hole 43 is provided, which makes it possible to proportionately ensure the deformability of the medial foot-side highly rigid member 40A and the lateral foot-side highly rigid member 40B while increasing the rigidity thereof.

As shown in FIGS. 1 to 7, the shock absorber 50 is assembled mainly to the midsole 20 and formed of a single block-shaped member. The shock absorber 50 is mainly relatively easily elastically deformed when it receives a compressive load and is provided for locally enhancing the shock absorbing performance of the sole 10. The shock absorber 50 is accommodated in the above-mentioned pocket-shaped space defined by the midsole 20, the rear-side outsole 30B, the medial foot-side highly rigid member 40A, and the lateral foot-side highly rigid member 40B.

Referring particularly to FIGS. 7 to 10, the shock absorber 50 includes a top surface 51, a bottom surface 52, and a peripheral surface connecting the top surface 51 and the bottom surface 52. The shock absorber 50 is designed such that its shape is variously adjusted so as to enhance the deformability when it receives a load in the up-down direction. The detailed shape of the shock absorber 50 will be described later.

As shown in FIGS. 2, 5, 6, and 8, the shock absorber 50 is disposed to overlap or surround the heel center HC of the sole 10. In the present embodiment, the shock absorber 50 has an annular shape as described later, and thus, the shock absorber 50 is located to surround the heel center HC of the sole 10 so as to be disposed inside the above-mentioned pocket-shaped space.

Specifically, the top surface 51 of the shock absorber 50 is bonded to the bottom surface 22 of the midsole 20, for example, by adhesion or the like, and the bottom surface 52 of the shock absorber 50 is bonded, for example, by adhesion or the like to the top surface 31 of the outsole 30 and the top surface 41*a* of the bottom wall portion 41 of each of the medial foot-side highly rigid member 40A and the lateral foot-side highly rigid member 40B. In other words, the shock absorber 50 that is sandwiched mainly by the midsole 20 and the outsole 30 in the up-down direction is assembled to the sole 10.

In this case, the shock absorber 50 is disposed to face the sidewall portion 42 of the medial foot-side highly rigid member 40A at a distance from this sidewall portion 42 in the left-right direction, and disposed to face the sidewall portion 42 of the lateral foot-side highly rigid member 40B at a distance from this sidewall portion 42 in the left-right direction. In addition, the shock absorber 50 is disposed to face, at a distance in the front-rear direction, the leg portion 25 of the midsole 20 and a part of the bottom surface 22 that has the inclined shape and to which the shock absorber 50 is not bonded.

Thus, in the sole 10, the shock absorber 50 is surrounded by the above-mentioned pocket-shaped space in the direction intersecting the up-down direction, and accordingly, the peripheral surface of the shock absorber 50 is not in contact with the surrounding members and is open to space. The pocket-shaped space serves as a margin for deformation when the shock absorber 50 deforms.

The shock absorber 50 is preferably excellent in shock absorbing performance while having proper strength. From this viewpoint, the shock absorber 50 is formed of a solid viscoelastic body. As the solid viscoelastic body, for example, a soft elastomer can be used. When the shock absorber 50 is made of resin, the material of the shock absorber 50 can be a polyolefin resin, an ethylene-vinyl acetate copolymer (EVA), a polyamide-based thermoplastic elastomer (TPA, TPAE), thermoplastic polyurethane (TPU), and a polyester-based thermoplastic elastomer (TPEE). On the other hand, when the shock absorber 50 is made of rubber, for example, butadiene rubber can be used.

The shock absorber 50 can also be formed of a polymer composition. In that case, examples of polymer to be contained in the polymer composition include olefinic polymers such as olefinic elastomers and olefinic resins. Examples of the olefinic polymers include polyolefins such as polyethylene (e.g., linear low density polyethylene (LLDPE), high density polyethylene (HDPE), and the like), polypropylene, ethylene-propylene copolymer, propylene-1-hexene copolymer, propylene-4-methyl-1-pentene copolymer, propylene-1-butene copolymer, ethylene-1-hexene copolymer, ethylene-4-methyl-pentene copolymer, ethylene-1-butene copolymer, 1-butene-1-hexene copolymer, 1-butene-4-methyl-pentene, ethylene-methacrylic acid copolymer, ethylene-methyl methacrylate copolymer, ethylene-ethyl methacrylate copolymer, ethylene-butyl methacrylate copolymer, ethylene-methyl acrylate copolymer, ethylene-ethyl acrylate copolymer, ethylene-butyl acrylate copolymer, propylene-methacrylic acid copolymer, propylene-methyl methacrylate copolymer, propylene-ethyl methacrylate copolymer, propylene-butyl methacrylate copolymer, propylene-methyl acrylate copolymer, propylene-ethyl acrylate copolymer, propylene-butyl acrylate copolymer, ethylene-vinyl acetate copolymer (EVA), propylene-vinyl acetate copolymer, and the like.

The polymer can be an amide-based polymer such as an amide-based elastomer and an amide-based resin. Examples of the amide-based polymer include polyamide 6, polyamide 11, polyamide 12, polyamide 66, polyamide 610, and the like.

The polymer can be an ester-based polymer such as an ester-based elastomer and an ester-based resin. Examples of the ester-based polymer include polyethylene terephthalate and polybutylene terephthalate.

The polymer can be a urethane-based polymer such as a urethane-based elastomer and a urethane-based resin. Examples of the urethane-based polymer include polyester-based polyurethane and polyether-based polyurethane.

The polymer can be a styrene-based polymer such as a styrene-based elastomer and a styrene-based resin. Examples of the styrene-based elastomer include styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), and the like. Examples of the styrene-based resin include polystyrene, acrylonitrile styrene resin (AS), acrylonitrile butadiene styrene resin (ABS), and the like.

Examples of the polymer include acrylic polymers such as polymethylmethacrylate, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated products thereof, urethane-based methacrylic polymers, polyester-based methacrylic polymers, polyether-based methacrylic polymers, polycarbonate-based methacrylic polymers, epoxy-based methacrylic polymers, conjugated diene polymer-based methacrylic polymers and hydrogenated products thereof, polyvinyl chloride-based resins, silicone-based elastomers, butadiene rubber (BR), isoprene rubber (IR), chloroprene rubber (CR), natural rubber (NR), styrene-butadiene rubber (SBR), acrylonitrile-butadiene rubber (NBR), butyl rubber (IIR), and the like.

As described above, in the sole 10 according to the present embodiment and the shoe 100 including the sole 10, the shock absorber 50 is disposed in the pocket-shaped space defined by the midsole 20, the rear-side outsole 30B, the medial foot-side highly rigid member 40A, and the lateral foot-side highly rigid member 40B. Also, the shock absorber 50 is mainly sandwiched by the midsole 20 and the outsole 30 in the up-down direction, and the pocket-shaped space surrounds the shock absorber 50, so that the peripheral surface of the shock absorber 50 is open to space.

According to such a configuration, the shock absorber 50 can be disposed to overlap or surround the heel center HC, which makes it possible to implement a sole and a shoe that are excellent in durability and weight reduction while enhancing the shock absorbing performance.

This is due to the following reason. Specifically, the foam material is generally lightweight and excellent in deformability but undergoes deterioration including what is called a collapse when it repeatedly receives a high load. In this point, it is difficult to say that the foam material is excellent in durability. On the other hand, a solid viscoelastic body is generally more excellent in durability than the foam material and has deformability close to that of the foam material, but this solid viscoelastic body is problematically heavy. In the sole 10 according to the present embodiment and shoe 100 including the same, however, the shock absorber 50 formed of a solid viscoelastic body having sufficiently high shock absorbing performance is locally disposed to overlap or surround the heel center HC of the rearfoot portion R3 as described above, to thereby reduce the amount of the foam material used particularly in the portion that receives a high load in the sole 10, which makes it possible to suppress durability decrease resulting from a collapse in the foam material, and also possible to reduce the weight since the pocket-shaped space surrounds the shock absorber. Note that the foam material in the portion of the rearfoot portion R3 that overlaps the heel center HC is not completely eliminated since the foam material generally allows a more excellent feel of contact for the wearer's foot and a more comfortable fit to the wearer's foot than those in the case of the solid viscoelastic body.

In addition, the foam material, which is generally low in Poisson's ratio, can ensure a proportionately high deformability even when it is constrained from the outside in the direction intersecting the direction in which a load is applied. On the other hand, the solid viscoelastic body, which is generally high in Poisson's ratio, is significantly decreased in deformability when it is constrained from the outside in the above-mentioned direction. In this regard, in the sole 10 according to the present embodiment and the shoe 100 including the same, the shock absorber 50 is surrounded by the pocket-shaped space as described above, so that the peripheral surface of the shock absorber 50 is open to space. Thus, the pocket-shaped space serves as a margin for deformation of the shock absorber 50, which prevents the shock absorber 50 from being constrained from outside as described above, with the result that the deformability of the shock absorber 50 may not decrease. Therefore, the sole 10 according to the present embodiment and the shoe 100 including the same exhibit high shock absorbing performance also in this respect.

Further, in the sole 10 according to the present embodiment and the shoe 100 including the same, the medial foot-side highly rigid member 40A and the lateral foot-side highly rigid member 40B are disposed at the respective portions of the medial foot-side end portion and the lateral foot-side end portion of the sole 10 that correspond to the pocket-shaped space, as described above. When the medial foot-side highly rigid member 40A and the lateral foot-side highly rigid member 40B are not disposed at these respective portions, the stability at the time of landing on the ground significantly deteriorates. However, disposing the medial foot-side highly rigid member 40A and the lateral foot-side highly rigid member 40B in this manner makes it possible to locally enhance the rigidity of the end portions of the pocket-shaped space in the left-right direction in which the shock absorber 50 is disposed, with the result that the stability at the time of landing on the ground can also be sufficiently ensured.

Therefore, the sole 10 according to the present embodiment and the shoe 100 including the same as described above make it possible to implement a shoe and a sole provided in the shoe that are excellent in shock absorbing performance, stability, durability, and weight reduction, and also make it possible to implement the shock absorbing performance, stability, durability, and weight reduction in unconventionally high dimensions. Thus, a sole achieving unconventionally high performance and a shoe including this sole can be implemented.

In the sole 10 according to the present embodiment and the shoe 100, in addition to the above-described points, the shock absorber 50 and the like are variously modified for refinement particularly from the viewpoint of enhancing the shock absorbing performance, which will be hereinafter sequentially described.

Particularly as shown in FIGS. 8 to 10, in the sole 10 according to the present embodiment, the shock absorber 50 provided in the sole 10 has a substantially frustum shape whose outer shape becomes smaller from the bottom surface 52 toward the top surface 51 in an overall view of the shock absorber 50. In the present embodiment, the shock absorber 50 has a substantially hexagonal frustum shape in an overall view of the shock absorber 50.

By forming the shock absorber 50 such that its outer shape becomes smaller from the bottom surface 52 toward the top surface 51 in this way, the load applied from the wearer's foot to the shock absorber 50 at the time of landing on the ground can be dispersed and propagated to the ground or the like through the ground contact surface 12. Thereby, the wearer's foot can be prevented from wobbling at the time of landing on the ground, so that the stability can be enhanced. Note that the shape of the shock absorber 50 is not limited to a hexagonal frustum shape but can be modified to various shapes including other polygonal frustum shapes typified by a quadrangular frustum shape, an octagonal frustum shape or the like, or a conical frustum shape, an elliptical frustum shape, or the like.

Further, in the sole 10 according to the present embodiment, the shock absorber 50 is configured to have a hollow portion 53 so as to have an annular shape and is also configured to have a cut 54 at a prescribed position in the circumferential direction so as to have a substantially C shape.

By providing the hollow portion 53 in the shock absorber 50 in this manner, the hollow portion 53 also serves as a margin for deformation of the shock absorber 50, and thus, the shock absorbing performance of the shock absorber 50 can be dramatically enhanced. In addition, when the cut 54 is provided at a prescribed position in the circumferential direction, the degree of freedom of deformation of the shock absorber 50 is enhanced, and thereby, the shock absorbing performance of the shock absorber 50 can also be dramatically enhanced.

In this case, as shown in FIG. 8, the above-mentioned cut 54 is preferably located at the rear end of the sole 10. This is due to the following reason. Specifically, the portion having the cut 54 in the shock absorber 50 is remarkably highly deformable. Thus, a higher shock absorbing performance is achieved by arranging this portion having the cut 54 to be located at the rear end of the sole 10 that receives a particularly high load since this rear end is the first part that comes into contact with the ground when a foot lands on the ground.

Further, particularly as shown in FIGS. 8 to 10, in the sole 10 according to the present embodiment, an annular stepped portion 55 having a recessed shape is disposed on the inner peripheral edge of the top surface 51 of the shock absorber 50. This annular stepped portion 55 having a recessed shape is provided to face the hollow portion 53.

By providing the annular stepped portion 55 in this manner, the pressure receiving surface of the shock absorber 50 for the load applied from the wearer's foot through the midsole 20 can be formed in a recessed shape. This allows the midsole 20 to sink to thereby enhance the above-mentioned effect of dispersing the load, with the result that not only high shock absorbing performance can be achieved but also the stability at the time of landing on the ground can be increased.

Further, in the sole 10 according to the present embodiment, the top surface 51 of the shock absorber 50 includes a plurality of top surface-side groove portions 56 extending from the inner peripheral edge to the outer peripheral edge of the top surface 51. In the present embodiment, a pair of the top surface-side groove portions 56 are disposed on the medial foot side and the lateral foot side so as to extend substantially in the left-right direction.

By providing the top surface-side groove portions 56 in this manner, the top surface-side groove portions 56 each also serve as a margin for deformation of the shock absorber 50, so that the shock absorbing performance of the shock absorber 50 can be further enhanced. Note that the number, arrangement position and the like of the top surface-side groove portions 56 can be variously changed.

Further, particularly as shown in FIGS. 3 to 5, in the sole 10 according to the present embodiment, the top surface 51 of the shock absorber 50 is formed as an inclined surface inclined downward toward the front side.

By forming the top surface 51 as an inclined surface inclined downward toward the front side in this manner, the load applied from the wearer's foot to the shock absorber 50 at the time of landing on the ground is easily propagated forward. Thus, the load can be propagated in the direction in which the force flows in the landing operation during which the foot lands on the ground in the order of the rearfoot portion R3, the midfoot portion R2, and the forefoot portion R1, and thereby, the energy loss during walking and running can be suppressed.

In addition, particularly as shown in FIGS. 8 to 10, in the sole 10 according to the present embodiment, the bottom surface 52 of the shock absorber 50 includes a bottom surface-side groove portion 57 extending in the front-rear direction. In the present embodiment, one bottom surface-side groove portion 57 is provided in a substantially central portion in the left-right direction.

By providing the bottom surface-side groove portion 57 extending in the front-rear direction in the bottom surface 52 in this manner, the load applied from the wearer's foot to the shock absorber 50 at the time of landing on the ground is easily propagated forward. Thus, the load can be propagated in the direction in which the force flows in the landing operation during which the foot lands on the ground in the order of the rearfoot portion R3, the midfoot portion R2, and the forefoot portion R1, and thereby, the energy loss during walking and running can be suppressed. Note that the number, arrangement position and the like of the bottom surface-side groove portion 57 can be variously changed.

Further, in the shoe 100 according to the present embodiment, as shown in FIG. 1, the sidewall portion 42 of the lateral foot-side highly rigid member 40B extends beyond the lateral foot-side side surface 24 of the midsole 20 to cover the bottom end portion of the lateral foot-side side surface of the upper body 61 and is bonded to this portion of the upper body 61, for example, by adhesion or the like. Further, although not shown in FIG. 1, the sidewall portion 42 of the medial foot-side highly rigid member 40A also extends beyond the medial foot-side side surface 23 of the midsole 20 to cover the bottom end portion of the medial foot-side side surface of the upper body 61 and is bonded to this portion of the upper body 61 (which is a portion at which a part of the sidewall portion 42 that protrudes upward beyond the midsole 20 is bonded to the upper body 61 as shown in FIG. 5), for example, by adhesion or the like.

In such a configuration, the top end portion of the medial foot-side highly rigid member 40A and the top end portion of the lateral foot-side highly rigid member 40B are located to face the medial foot-side side surface and the lateral foot-side side surface, respectively, of the heel portion of the wearer's foot. Thus, when a phenomenon including what is called an overpronation or an underpronation occurs in which the wearer's heel portion collapses excessively leftward or rightward at the time of landing on the ground, the medial foot-side highly rigid member 40A and the lateral foot-side highly rigid member 40B support the collapsed heel portion, which makes it possible to effectively suppress further collapse of the wearer's heel portion.

Further, in the shoe 100 according to the present embodiment, as shown in FIGS. 2 and 8, the front end of the medial foot-side highly rigid member 40A is located forward of the front end of the lateral foot-side highly rigid member 40B. In such a configuration, the rigidity is higher on the medial foot side than on the lateral foot side particularly in an overall view of the sole 10, which makes it possible to suppress occurrence of an overpronation in which the wearer's heel portion excessively collapses toward the medial foot side at the time of landing on the ground.

First to Tenth Modifications

Figure 11A:
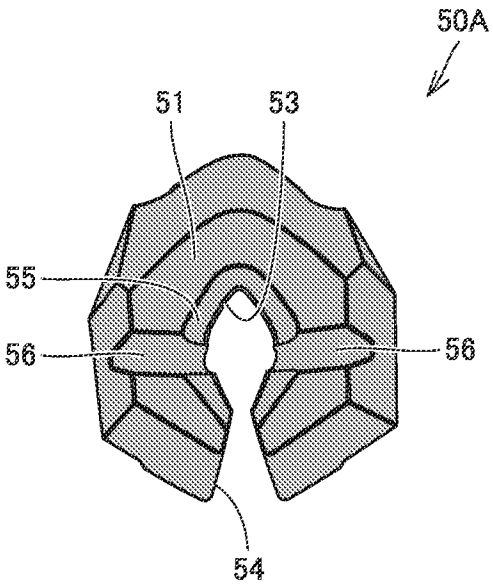
FIGS. 11A to 11C are plan views of shock absorbers according to first to third modifications.
Figure 11B:
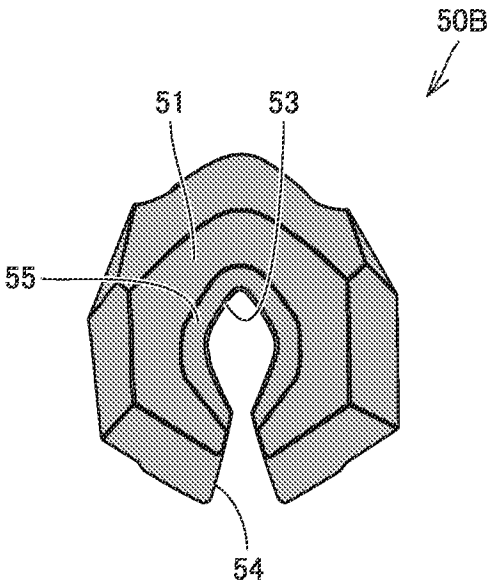
Figure 11C:
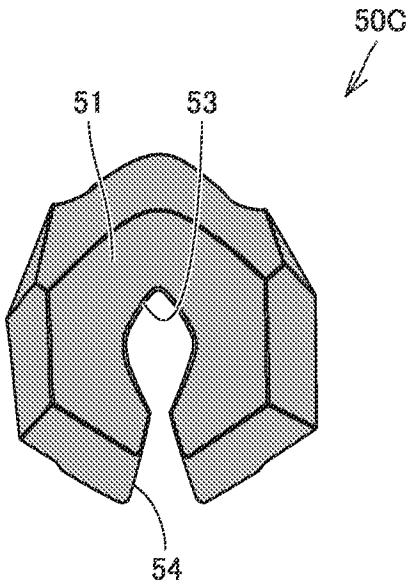
Figure 12C:
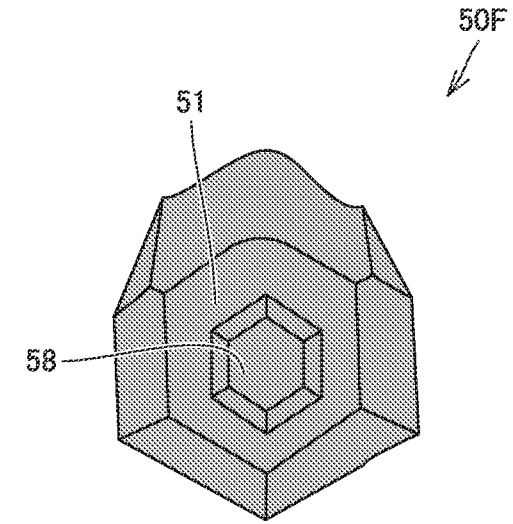
FIGS. 12A to 12C are plan views of shock absorbers according to fourth to sixth modifications.
Figure 12B:
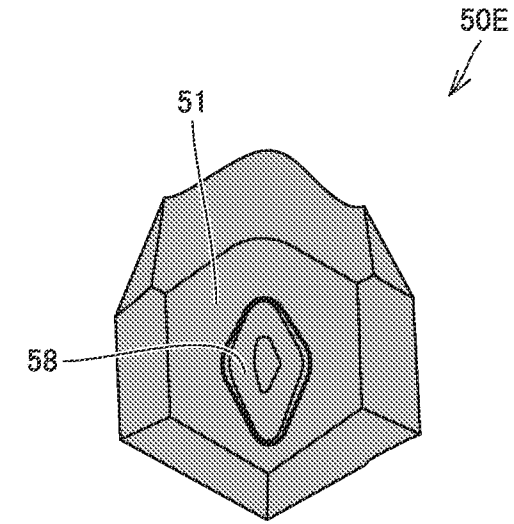
Figure 12A:
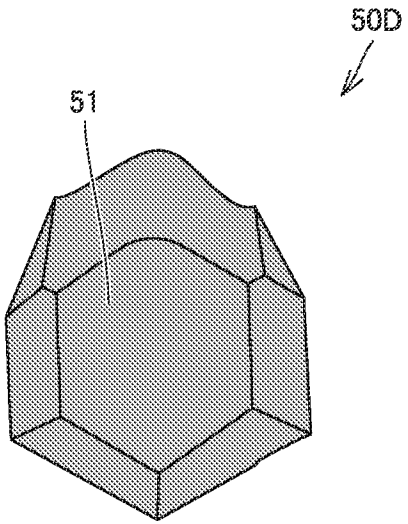
Figure 13C:
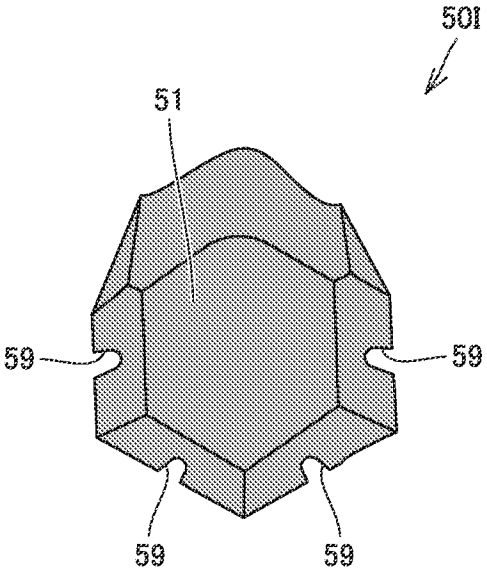
FIGS. 13A to 13C are plan views of shock absorbers according to seventh to ninth modifications.
Figure 13B:
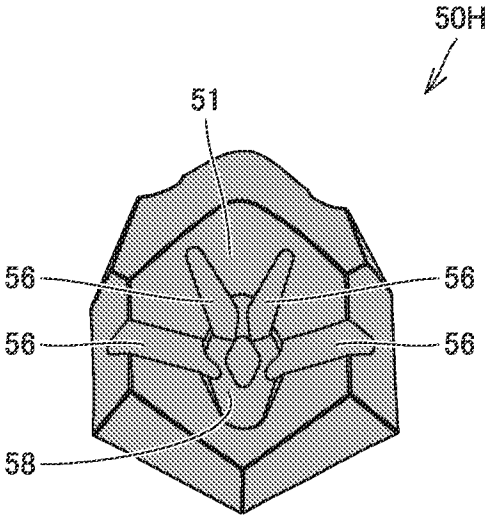
Figure 13A:
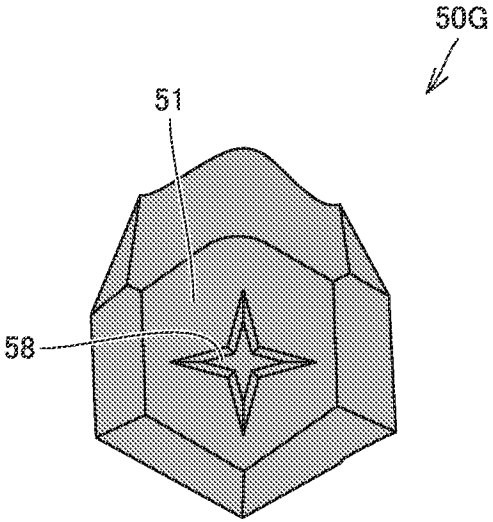
Figure 14:
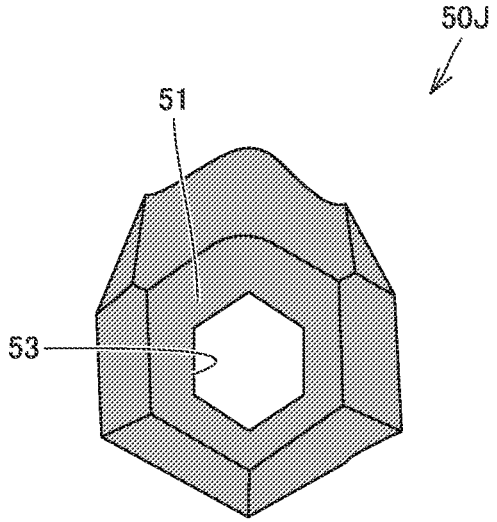
FIG. 14 is a plan view of a shock absorber according to a tenth modification.

FIGS. 11A, 11B, and 11C are plan views of shock absorbers according to the first, second, and third modifications, respectively. FIGS. 12A, 12B, and 12C are plan views of shock absorbers according to the fourth, fifth, and sixth modifications, respectively. FIGS. 13A, 13B, and 13C are plan views of shock absorber according to the seventh, eighth, and ninth modifications, respectively. FIG. 14 is a plan view of a shock absorber according to the tenth modification. Referring to FIGS. 11A to 14, the following describes shock absorbers 50A to 50J according to the first to tenth modifications based on the above-described embodiment. In place of the shock absorber 50 provided in the sole 10 according to the above-described embodiment and the shoe 100, the shock absorbers 50A to 50J according to the first to tenth modifications are each provided in the sole 10 and the shoe 100.

As shown in FIG. 11A, the shock absorber 50A according to the first modification is different from the shock absorber 50 according to the above-described embodiment only in that the shock absorber 50A does not include the bottom surface-side groove portion 57 (see FIG. 10 and the like).

As shown in FIG. 11B, the shock absorber 50B according to the second modification is different from the shock absorber 50 according to the above-described embodiment only in that the shock absorber 50B does not include the bottom surface-side groove portion 57 (see FIG. 10 and the like) and the top surface-side groove portion 56 (see FIG. 9 and the like).

As shown in FIG. 11C, the shock absorber 50C according to the third modification is different from the shock absorber 50 according to the above-described embodiment only in that the shock absorber 50C does not include the bottom surface-side groove portion 57 (see FIG. 10 and the like), the top surface-side groove portion 56, and the annular stepped portion 55 (see FIG. 9 and the like).

As shown in FIG. 12A, the shock absorber 50D according to the fourth modification is different from the shock absorber 50 according to the above-described embodiment only in that the shock absorber 50D does not include the bottom surface-side groove portion 57 (see FIG. 10 and the like), the top surface-side groove portion 56, the annular stepped portion 55, the hollow portion 53, and the cut 54 (see FIG. 9 and the like).

Even when the shock absorber 50D does not include any one or two or more of the bottom surface-side groove portion 57, the top surface-side groove portion 56, the annular stepped portion 55, the hollow portion 53, and the cut 54 that are included in the shock absorber 50 according to the above-described embodiment in this manner, proportionate shock absorbing performance is achieved, and thus, the effect similar to that explained in the above-described embodiment can be achieved.

As shown in FIG. 12B, the shock absorber 50E according to the fifth modification is different from the shock absorber 50D according to the above-mentioned fourth modification only in that the top surface 51 includes a recess 58 having a substantially rhombus shape in a plan view.

As shown in FIG. 12C, the shock absorber 50F according to the sixth modification is different from the shock absorber 50D according to the above-mentioned fourth modification only in that the top surface 51 includes a recess 58 having a hexagonal shape in a plan view.

As shown in FIG. 13A, the shock absorber 50G according to the seventh modification is different from the shock absorber 50D according to the above-mentioned fourth modification only in that the top surface 51 includes a recess 58 having a cross shape in a plan view.

As shown in FIG. 13B, the shock absorber 50H according to the eighth modification is different from the shock absorber 50D according to the above-mentioned fourth modification only in that the top surface 51 includes a recess 58 having a substantially rhombus shape in a plan view and the top surface 51 also includes a plurality of top surface-side groove portions 56 extending from the inside toward the outside.

As shown in FIG. 13C, the shock absorber 50I according to the ninth modification is different from the shock absorber 50D according to the above-mentioned fourth modification only in that the peripheral surface includes a plurality of peripheral surface-side groove portions 59.

As shown in FIG. 14, the shock absorber 50J according to the tenth modification is different from the shock absorber 50D according to the above-mentioned fourth modification only in that the hollow portion 53 having a hexagonal shape in a plan view is provided to reach each of the top surface 51 and the bottom surface 52.

Also in the case where recesses, groove portions, hollow portions and the like (i.e., various types of vacant portions) having various shapes are provided in place of the bottom surface-side groove portion 57, the top surface-side groove portion 56, the annular stepped portion 55, the hollow portion 53, and the cut 54 provided in the shock absorber 50 according to the above-described embodiment in this manner, proportionate shock absorbing performance is achieved, and thus, the effect similar to that explained in the above-described embodiment can be achieved.

In the case where the shock absorbers 50D to 50I according to the fourth to ninth modifications as described above are each provided in the sole 10 and the shoe 100, the shock absorbers 50D to 50I each are disposed to overlap the heel center HC of the sole 10 since the shock absorbers 50D to 50I each do not have an annular shape.

Summary of the Disclosure in Embodiment and Modifications

The following is a summary of the features disclosed in the above-described embodiment, modifications thereof, and the like.

Supplementary Note 1

A sole having a midfoot portion configured to support an arch portion of a foot of a wearer, a forefoot portion located in front of the midfoot portion, and a rearfoot portion located behind the midfoot portion, the sole including:

a midsole; and an outsole located beneath the midsole, wherein the midsole is made of a foam material, the rearfoot portion includes a facing region in which the midsole and the outsole are disposed to face each other at a distance from each other in an up-down direction, the facing region being located in a portion including a heel center of the sole when viewed in a direction normal to a bottom surface of the sole, the facing region includes a shock absorber formed of a solid viscoelastic body, the shock absorber being sandwiched in the up-down direction by the midsole and the outsole, the shock absorber is located to overlap or surround the heel center, at a medial foot-side end portion in a portion of the rearfoot portion that corresponds to the facing region, a medial foot-side highly rigid member having a panel shape is provided, the medial foot-side highly rigid member being higher in rigidity than the shock absorber, at a lateral foot-side end portion in a portion of the rearfoot portion that corresponds to the facing region, a lateral foot-side highly rigid member having a panel shape is provided, the lateral foot-side highly rigid member being higher in rigidity than the shock absorber, and a pocket-shaped space that surrounds the shock absorber is provided in the facing region by fixing a top side portion of the medial foot-side highly rigid member to the midsole and fixing a bottom side portion of the medial foot-side highly rigid member to the outsole such that the medial foot-side highly rigid member is disposed to face the shock absorber at a distance from the shock absorber in a left-right direction, and fixing a top side portion of the lateral foot-side highly rigid member to the midsole and fixing a bottom side portion of the lateral foot-side highly rigid member to the outsole such that the lateral foot-side highly rigid member is disposed to face the shock absorber at a distance from the shock absorber in the left-right direction.

Supplementary Note 2

The sole according to Supplementary Note 1, wherein the shock absorber has an annular shape having a cut in a circumferential direction, the annular shape being provided to surround the heel center, and the cut is located at a rear end of the sole.

Supplementary Note 3

The sole according to Supplementary Note 2, wherein an inner peripheral edge of a top surface of the shock absorber includes an annular stepped portion having a recessed shape.

Supplementary Note 4

The sole according to Supplementary Note 2 or 3, wherein a top surface of the shock absorber includes a groove portion that extends from an inner peripheral edge to an outer peripheral edge of the top surface.

Supplementary Note 5

The sole according to any one of Supplementary Notes 1 to 4, wherein a top surface of the shock absorber is formed as an inclined surface inclined downward toward a front side.

Supplementary Note 6

The sole according to any one of Supplementary Notes 1 to 5, wherein the shock absorber substantially has a frustum shape having an outer shape that becomes smaller from a bottom surface toward a top surface of the shock absorber.

Supplementary Note 7

The sole according to any one of Supplementary Notes 1 to 6, wherein a through hole penetrating through the medial foot-side highly rigid member in the left-right direction is provided, and a through hole penetrating through the lateral foot-side highly rigid member in the left-right direction is provided.

Supplementary Note 8

The sole according to any one of Supplementary Notes 1 to 7, wherein the medial foot-side highly rigid member includes a first bottom wall portion having a plate shape and extending substantially in a front-rear direction and the left-right direction, and a first sidewall portion having a plate shape and extending substantially in the front-rear direction and the up-down direction, the first sidewall portion being provided to stand upright from a medial foot-side edge portion of the first bottom wall portion, a bottom surface of the first bottom wall portion is bonded to a top surface of the outsole, a lateral foot-side wall surface of the first sidewall portion is bonded to a medial foot-side side surface of the midsole, the lateral foot-side highly rigid member includes a second bottom wall portion having a plate shape and extending substantially in the front-rear direction and the left-right direction, and a second sidewall portion having a plate shape and extending substantially in the front-rear direction and the up-down direction, the second sidewall portion being provided to stand upright from a lateral foot-side edge portion of the second bottom wall portion, a bottom surface of the second bottom wall portion is bonded to the top surface of the outsole, and a medial foot-side wall surface of the second sidewall portion is bonded to a lateral foot-side side surface of the midsole.

Supplementary Note 9

The sole according to any one of Supplementary Notes 1 to 8, wherein a front end of the medial foot-side highly rigid member is located forward of a front end of the lateral foot-side highly rigid member.

Supplementary Note 10

A shoe including:

the sole according to any one of Supplementary Notes 1 to 9; and an upper provided above the sole.

Supplementary Note 11

The shoe according to Supplementary Note 10, wherein the medial foot-side highly rigid member extends beyond a medial foot-side side surface of the midsole to cover a part of a medial foot-side side surface of the upper, the medial foot-side highly rigid member being bonded to the part of the medial foot-side side surface of the upper, and the lateral foot-side highly rigid member extends beyond a lateral foot-side side surface of the midsole to cover a part of a lateral foot-side side surface of the upper, the lateral foot-side highly rigid member being bonded to the part of the lateral foot-side side surface of the upper.

Other Configurations

The above embodiment and the modifications thereof have been described with reference to an example in which the shock absorber formed of a single member is disposed to overlap or surround the heel center, but the shock absorber disposed as described above can be divided into a plurality of members and disposed as described above. Further, the shock absorber is not necessarily disposed as described above, but another shock absorber can be disposed at a different position.

Further, the above embodiment and the modifications thereof have been described with reference to an example of a configuration in which a part of the bottom surface of the shock absorber is bonded to the top surface of the bottom wall portion of each of the medial foot-side highly rigid member and the lateral foot-side highly rigid member, but the bottom surface of the shock absorber can be bonded only to the top surface of the outsole.

Further, the above embodiment and the modifications thereof have been described with reference to an example in which the sidewall portion of each of the medial foot-side highly rigid member and the lateral foot-side highly rigid member has a rhombus shape in a side view and includes a through hole, but there is no particular limitation in the shape of the sidewall portion of each of the medial foot-side highly rigid member and the lateral foot-side highly rigid member, and the presence or absence of the through hole, and thus, various modifications are possible.

As described above, the shapes, sizes, arrangement positions, numbers, and the like of the midsole, the outsole, the medial foot-side highly rigid member, the lateral foot-side highly rigid member, and the shock absorber that constitute the sole can be variously changed without departing from the gist of the present disclosure, and in addition, the configuration, the shape, and the like of the upper can also be variously changed.

Further, the characteristic configurations illustrated in the above-described embodiment and the modifications thereof can be combined with each other without departing from the gist of the present disclosure.

Although the embodiment has been described as above, it should be understood that the embodiment disclosed herein is illustrative and non-restrictive in every respect. The scope of the present invention is defined by the scope of the claims and is intended to include any modifications within the meaning and scope equivalent to the scope of the claims.

What is claimed is:

1. A sole having a midfoot portion configured to support an arch portion of a foot of a wearer, a forefoot portion located in front of the midfoot portion, and a rearfoot portion located behind the midfoot portion, the sole comprising:

a midsole; and an outsole located beneath the midsole, the midsole being a foam material, the rearfoot portion including a facing region in which the midsole and the outsole are disposed to face each other at a distance from each other in an up-down direction, the facing region being located in a portion including a heel center of the sole when viewed in a direction normal to a bottom surface of the sole, the facing region including a shock absorber formed of a solid viscoelastic body, the shock absorber being sandwiched in the up-down direction by the midsole and the outsole, the shock absorber being located to overlap or surround the heel center, at a medial foot-side end portion in a portion of the rearfoot portion corresponding to the facing region, a medial foot-side highly rigid member having a panel shape being provided, the medial foot-side highly rigid member being higher in rigidity than the shock absorber, at a lateral foot-side end portion in a portion of the rearfoot portion corresponding to the facing region, a lateral foot-side highly rigid member having a panel shape being provided, the lateral foot-side highly rigid member being higher in rigidity than the shock absorber, and a pocket-shaped space surrounding the shock absorber and being disposed in the facing region such that a peripheral surface of the shock absorber is open to space and is not in contact with the medial foot-side highly rigid member or the lateral foot-side highly rigid member, a top side portion of the medial foot-side highly rigid member being fixed to the midsole and a bottom side portion of the medial foot-side highly rigid member being fixed to the outsole such that the medial foot-side highly rigid member is disposed to face the shock absorber at a distance from the shock absorber in a left-right direction, and a top side portion of the lateral foot-side highly rigid member being fixed to the midsole and a bottom side portion of the lateral foot-side highly rigid member being fixed to the outsole such that the lateral foot-side highly rigid member is disposed to face the shock absorber at a distance from the shock absorber in the left-right direction.

2. The sole according to claim 1, wherein the shock absorber has an annular shape having a cut in a circumferential direction, the annular shape being configured to surround the heel center, and the cut is located at a rear end of the sole.

3. The sole according to claim 2, wherein an inner peripheral edge of a top surface of the shock absorber includes an annular stepped portion having a recessed shape.

4. The sole according to claim 2, wherein a top surface of the shock absorber includes a groove portion extending from an inner peripheral edge to an outer peripheral edge of the top surface.

5. The sole according to claim 1, wherein a top surface of the shock absorber is an inclined surface inclined downward toward a front side.

6. The sole according to claim 1, wherein the shock absorber substantially has a frustum shape having an outer shape that becomes smaller from a bottom surface toward a top surface of the shock absorber.

7. The sole according to claim 1, wherein a through hole penetrates through the medial foot-side highly rigid member in the left-right direction, and a through hole penetrates through the lateral foot-side highly rigid member in the left-right direction.

8. The sole according to claim 1, wherein the medial foot-side highly rigid member includes a first bottom wall portion having a plate shape and extending substantially in a front-rear direction and the left-right direction, and a first sidewall portion having a plate shape and extending substantially in the front-rear direction and the up-down direction, the first sidewall portion being configured to stand upright from a medial foot-side edge portion of the first bottom wall portion, a bottom surface of the first bottom wall portion is bonded to a top surface of the outsole, a lateral foot-side wall surface of the first sidewall portion is bonded to a medial foot-side side surface of the midsole, the lateral foot-side highly rigid member includes a second bottom wall portion having a plate shape and extending substantially in the front-rear direction and the left-right direction, and a second sidewall portion having a plate shape and extending substantially in the front-rear direction and the up-down direction, the second sidewall portion being configured to stand upright from a lateral foot-side edge portion of the second bottom wall portion, a bottom surface of the second bottom wall portion is bonded to the top surface of the outsole, and a medial foot-side wall surface of the second sidewall portion is bonded to a lateral foot-side side surface of the midsole.

9. The sole according to claim 1, wherein a front end of the medial foot-side highly rigid member is located forward of a front end of the lateral foot-side highly rigid member.

10. A shoe comprising:

the sole according to claim 1; and an upper provided above the sole.

11. The shoe according to claim 10, wherein the medial foot-side highly rigid member extends beyond a medial foot-side side surface of the midsole to cover a part of a medial foot-side side surface of the upper, the medial foot-side highly rigid member being bonded to the part of the medial foot-side side surface of the upper, and the lateral foot-side highly rigid member extends beyond a lateral foot-side side surface of the midsole to cover a pall of a lateral foot-side side surface of the upper, the lateral foot-side highly rigid member being bonded to the part of the lateral foot-side side surface of the upper.

* * * * *